United States Patent [19]

Lynch et al.

[11] Patent Number: 4,954,755

[45] Date of Patent: Sep. 4, 1990

[54] ELECTRODELESS LAMP HAVING HYBRID CAVITY

[75] Inventors: Donald Lynch, Germantown; Mohammad Kamarehi, Rockville; Michael G. Ury, Bethesda; Charles H. Wood, Rockville, all of Md.

[73] Assignee: Fusion Systems Corporation, Rockville, Md.

[21] Appl. No.: 177,434

[22] Filed: Apr. 4, 1988

Related U.S. Application Data

[63] Continuation of Ser. No. 865,488, May 21, 1986, Pat. No. 4,749,915, which is a continuation-in-part of Ser. No. 677,137, Nov. 30, 1984, abandoned, which is a continuation-in-part of Ser. No. 381,482, May 24, 1983, Pat. No. 4,507,587.

[51] Int. Cl.[5] ..... H05B 41/16

[52] U.S. Cl. ..... 315/248; 315/39; 315/246

[58] Field of Search ..... 315/39, 39.3, 248, 246, 315/DIG. 5

[56] References Cited

U.S. PATENT DOCUMENTS

| | | | |
|---|---|---|---|
| 4,042,850 | 8/1977 | Ury et al. | 315/39 |
| 4,144,436 | 3/1979 | Hauck | 219/10.55 F |
| 4,266,162 | 5/1981 | McNeill et al. | 315/39 |
| 4,359,668 | 11/1982 | Ury | 315/39 |
| 4,498,029 | 2/1985 | Yoshizawa et al. | 315/39 |
| 4,504,768 | 3/1985 | Ury et al. | 315/39 |
| 4,507,587 | 3/1985 | Wood et al. | 315/39 |

FOREIGN PATENT DOCUMENTS 123954 8/1985 Japan .

*Primary Examiner*—Leo H. Boudreau
*Assistant Examiner*—Michael Razavi
*Attorney, Agent, or Firm*—Pollock, Vande Sande & Priddy

[57] ABSTRACT

A microwave powered electrodeless lamp which employs a hybrid cylindrical cavity which is part mesh and part solid. The cylindrical mesh portion permits the lamp to be used with an external reflector while the cylindrical solid portion enables a plurality of waveguides to be coupled to the cavity for high power operation.

6 Claims, 2 Drawing Sheets

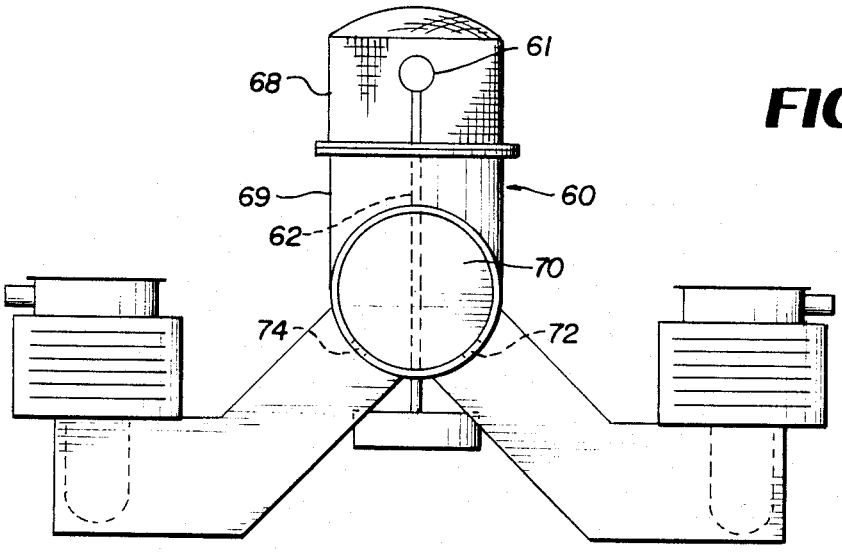
FIG. 5
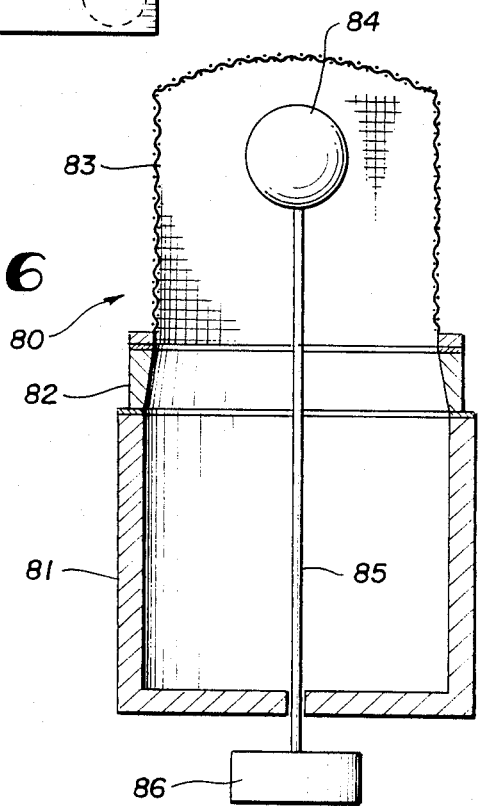
FIG. 6
FIG. 7
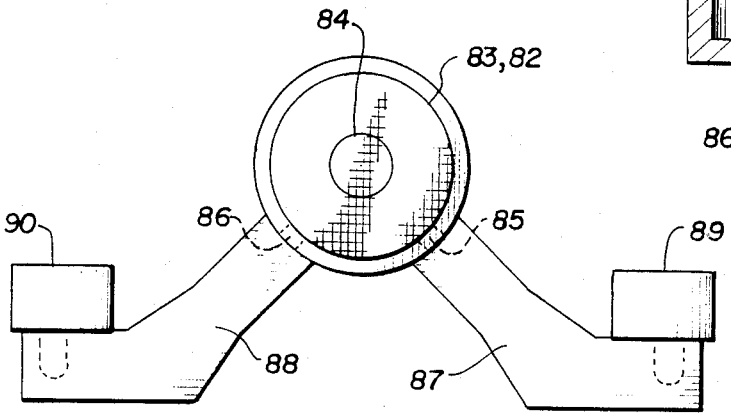

ELECTRODELESS LAMP HAVING HYBRID CAVITY

This application is a continuation of U.S. application Ser. No. 865,488, filed May 21, 1985, now U.S. Pat. No. 4,749,915, which is a continuation in part of U.S. application Ser. No. 677,137, filed Nov. 30, 1984, now abandoned, which in turn is a continuation in part of U.S. application Ser. No. 381,482, filed May 24, 1982, now U.S. Pat. No. 4,507,587.

The present invention is directed to an improved microwave powered electrodeless light source.

In recent years electrodeless light sources have become well known, and have found use in applications such as semiconductor device fabrication and the curing of photopolymerizable coatings and inks. Further, such sources may be useful for visible lighting applications.

In general, electrodeless light sources include a microwave cavity or chamber in which there is disposed an envelope or bulb containing a plasma-forming medium. A magnetron is provided for generating microwave energy, which is coupled to the cavity through a slot for exciting a plasma in the bulb, which emits radiation upon being excited. This radiation exits from the cavity through a mesh portion thereof which is opaque to microwave energy but transparent to the radiation emitted from the bulb.

In one known type of electrodeless light source, such as is shown in U.S. Pat. No. 4,042,850 to Ury, et al., the microwave enclosure is comprised of a solid metallic portion and a plasma mesh which "closes" the solid portion. In such a lamp configuration, the solid portion of the microwave enclosure also serves as a reflector for reflecting the emitted light through the mesh.

In another known type of electrodeless lamp, as exemplified by that disclosed in Japanese laid-open Applications Nos. 59-6032 and 60-123955, the microwave cavity is comprised substantially only of mesh. The advantage of this type of structure is that it can be used with an exterior reflector of any selected shape and the optical properties of the reflector are therefore not limited by microwave considerations, as in the type of lamp described in the preceding paragraph.

A limitation of the mesh cavity has heretofore been that it could only be easily used with a single magnetron. On the other hand, there may be instances where it is desirable to have a lamp which is powered by multiple magnetrons. For example, where high power is required, it has been found that as the power of a single magnetron is increased beyond a certain point, arcing across the coupling slot may occur. Also, at a certain power level, the cost of a magnetron rises steeply, and it therefore may be more economical to use two or more lower power magnetrons which are mass produced rather than a single, high power magnetron produced in limited quantities.

This problem is solved in accordance with the present invention, by providing an electrodeless lamp having a novel "hybrid" structure wherein the microwave cavity is comprised partly of a cylindrical mesh, and partly of a cylindrical solid portion having multiple coupling slots in a direction parallel to the cylindrical axis. Waveguides are coupled to the respective slots, and are fed by individual magnetrons to power the lamp.

In one embodiment, the modes generated by the respective magnetrons are de-coupled from each other by providing two coupling slots which are displaced from each other by 90° around the cylindrical surface of the cavity.

In a further embodiment, a large amount of power is coupled to the cavity by providing three coupling slots which are displaced from each other by 120°.

In addition to permitting the use of multiple magnetrons, the arrangement of the present invention permits the bulb to be mounted with its stem substantially in the direction of the cylindrical axis of the cavity, which facilitates bulb removal.

It is therefore an object of the present invention to provide a hybrid cavity, which is part mesh and part solid.

It is a further object of the invention to couple high microwave power levels to a bulb which is disposed in a mesh cavity portion.

It is still a further object of the invention to couple microwave power to a bulb in such manner to result in effective starting.

It is still a further object of the invention to provide an electrodeless lamp in which bulb removal is facilitated.

The invention will be better understood by referring to the accompanying drawings in which:

FIGS. 3 to 7 are pictorial illustrations of further embodiments of the invention.

Figure 1:
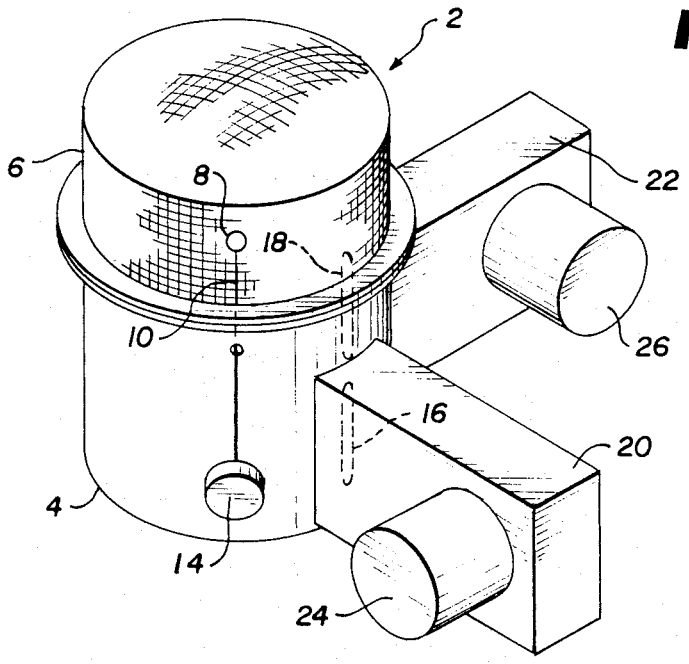
FIG. 1 is a pictorial illustration of an embodiment of the invention.

Referring to FIG. 1, a pictorial illustration of microwave powered electrodeless light source 2 is shown.

Light source 2 is comprised of a hybrid cylindrical cavity made up of solid portion 4 and mesh portion 6. A bulb 8 containing a plasma forming medium is disposed in or near mesh portion 6.

Further, solid cavity portion 4 has microwave coupling slots 16 and 18 disposed therein, which are in a direction which is parallel to the cylindrical axis of the cavity. Waveguides 20 and 22 feed the respective slots, and magnetrons 24 and 26 generate microwave energy in the respective waveguides.

Typically, bulb stem 10 would be rotated by motor 14 to impart rotation to the bulb 8 while a plurality of streams of cooling gas (not shown) would impinge on the bulb to cool it during operation.

In the operation of lamp 2, microwave energy generated by the magnetrons would be coupled into the microwave cavity through the respective coupling slots, and would excite a plasma in bulb 8, which would emit ultraviolet light.

Mesh cavity portion 6 is effective to retain the microwave energy in the cavity, while being substantially transparent to the emitted light.

An external reflector may be used in connection with electrodeless lamp 2 to reflect the light which is emitted through the mesh 6 as required for a particular application. Thus, the hybrid structure of the cavity shown permits an external reflector to be used while allowing multiple and magnetrons to power the lamp.

It is noted that in the embodiment of FIG. 1, coupling slots 16 and 18 are displaced from each other by 90°. This, combined with proper dimensioning of the cavity results in the $TE_{111}$ mode being set up in the cavity, wherein the electric fields generated by the respective magnetrons are orthogonal to each other. The fields are therefore de-coupled and there is no interference or cross-talk therebetween, which results in maximum power coupling to bulb 8.

Figure 2:
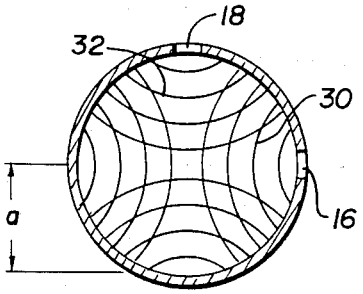
FIG. 2 is a diagram of the electric fields in the embodiment of FIG. 1.

This is illustrated in FIG. 2, which is a diagram showing the two electric fields in the cylindrical $TE_{111}$ mode. Field 30 is generated by the energy feeding through slot 16 while field 32 is generated by the energy feeding through slot 18. It is noted that a field with circumferential variation such as the $TE_{111}$ mode is required for orthogonality of the fields, since for example, the fields are in the radial direction in the cylindrical $TM_{011}$ mode and in the circumferential direction in the cylindrical $TE_{011}$ mode no matter where the slots are disposed in the cylindrical wall.

In the embodiment of FIG. 1, it is noted that the bulb is axially displaced from the slots, and in fact does not "see" the slots at all. This arrangement may promote evenness of bulb output as local distortions caused by slot proximity may be avoided.

Figure 3:
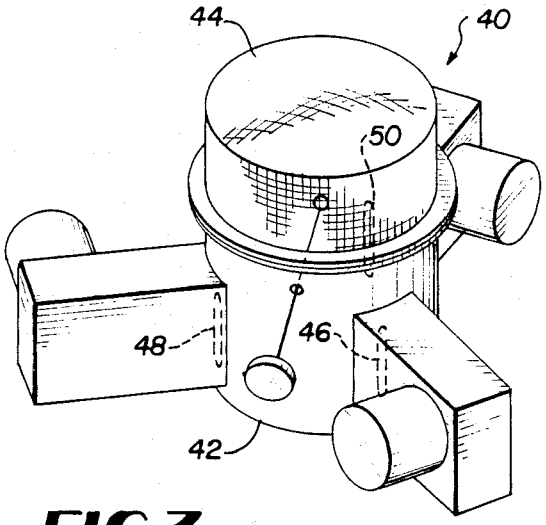

Referring to FIG. 3, a further embodiment of the invention is shown. Here, electrodeless lamp 40 is again comprised of a hybrid cavity consisting of solid portion 42 and mesh portion 44. However, this cavity has three coupling slots 46, 48, and 50, disposed 120° apart.

As in the preceding embodiment, each slot is fed by a waveguide and magnetron, and the slot arrangement causes the cavity to be in the cylindrical $TE_{111}$ mode. Unlike the embodiment of FIG. 1, since the slots are not 90° apart, there is some cross-coupling between the electric fields. However, the provision of an additional power source provides significantly more energy, and it has been found that for some applications the trade-off between total power and field coupling obtained with the embodiment of FIG. 3 provides the best overall results.

Figure 4:
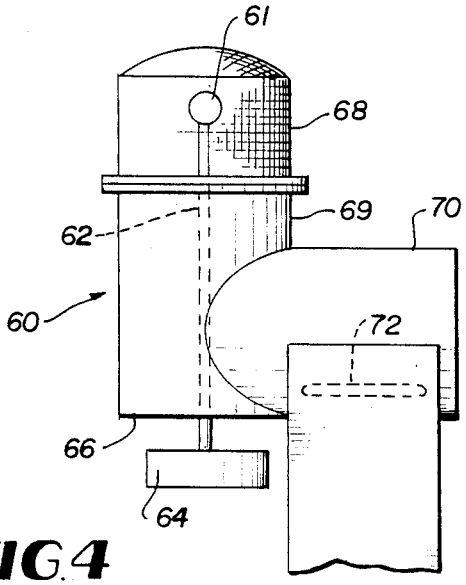

Referring to FIGS. 4 and 5, a further embodiment of the invention is shown, wherein the bulb is mounted by means of a stem mounted in the direction of the cylindrical axis of the cavity to facilitate easy removal thereof.

In this embodiment, lamp 60 is shown, wherein bulb 61 is mounted in the cavity by bulb stem 62, and if the bottom of the cavity is suitably arranged, the bulb and stem can be easily removed by pulling them out therethrough.

Further, the lamp illustrated in FIGS. 4 and 5 utilize a folded cylindrical cavity. The term "folded cylindrical cavity" refers to a cavity which is comprised of two cylindrical portions which are at 90° to each other.

Thus, the cavity is comprised of portion 69 which houses bulb 61 and portion 70 in which coupling slots 72 and 74 are disposed. These slots are displaced 90° from each other, so that orthogonal electric fields in the $TE_{111}$ mode are established.

The purpose of the folded cavity is to shorten the length of portion 69, which may make the lamp into a more convenient package and which may be physically necessary or desirable for certain applications for which the lamp is used. Strong coupling of the fields to the bulb is attained with the folded design.

A further embodiment of the invention is shown in FIGS. 6 and 7.

Referring to FIG. 6, lamp 80 has a hybrid cavity comprised of mesh 83 and solid portions 81 and 82, wherein portion 81 is cylindrical while portion 82 has a tapered or conical interior. Bulb 84 is mounted by bulb stem 85, which is rotated by motor 86.

Referring to FIG. 7, portion 81 of the cavity has two coupling slots 85 and 86 herein which are located 90° apart, each of which is fed by a respective waveguide 87 and 88, into which microwave energy from magnetrons 89 and 90 respectively are fed.

In an exemplary embodiment of the cylindrical cavity structure shown in FIG. 1, the diameter of the cavity is 2.90" and the length is 10.10", while the center of the bulb is positioned 1.15" from the screen and 6.75" from the center of the coupling slot.

In the embodiment shown in FIGS. 6 and 7, the diameter of the lower solid portion of the cavity is 3.10" (interior) while the diameter (interior) of the mesh is 2.90". The length of the cavity is 6.663", while the length of the coupling slots is 2.2", and the center of the bulb is positioned 4.232" from the center of the coupling slot.

While preferred and illustrative embodiments have been disclosed, it is to be understood that variations will occur to those skilled in the art, and the scope of the invention is to be limited only by the claims appended hereto and equivalents.

We claim:

1. An electrodeless light source which is powered by a plurality of means for generating microwave energy, comprising:

a microwave cavity having a cylindrical shape and being comprised of first and second portions of cylindrical shape, said first cylindrical portion being constructed of a mesh, and said second cylindrical portion being constructed of solid material, a bulb containing a plasma forming medium disposed in said cavity in or near said first cylindrical portion, said second cylindrical portion of said cavity having a plurality of coupling slots disposed therein parallel to the cylindrical axis of the cavity, a waveguide feeding each coupling slot, and a means for generating microwave energy feeding each waveguide.

2. A light source as in claim 1, wherein there are two coupling slots which are displaced from each other around said cylindrical cavity by 90°.

3. A light source as in claim 1 where there are three coupling slots which are displaced from each other around said cylindrical cavity by 120°.

4. A light source as in claim 1 wherein said bulb is axially displaced in position from said slots.

5. A light source as in claim 1 wherein the bulb is supported by a stem, and the stem is mounted along the direction of the cylindrical axis of the cavity.

6. A light source as in claim 1 wherein each means for generating microwave energy comprises a magnetron.

* * * * *